United States Patent [19]

Ansin et al.

[11] 4,038,811

[45] Aug. 2, 1977

[54] APPARATUS FOR CONTINUOUSLY DRAWING AND TEXTURING CORE AND EFFECT YARNS

[75] Inventors: Joseph L. Ansin, Lowell, Mass.; Stephen C. Harris, East Greenwich, R.I.

[73] Assignee: Joan Fabrics Corporation, Lowell, Mass.

[21] Appl. No.: 719,122

[22] Filed: Aug. 31, 1976

[51] Int. Cl.[2] ..... D02G 1/18; D02G 3/24; D01H 13/28; D01H 5/74

[52] U.S. Cl. ..... 57/34 B; 57/36; 57/38.3; 57/157 F

[58] Field of Search ..... 57/34 R, 34 B, 140 J, 57/157 F, 157 S, 157 R, 38.3, 36; 28/72.12, 72.11

[56] References Cited

U.S. PATENT DOCUMENTS

| | | | |
|---|---|---|---|
| 3,199,281 | 8/1965 | Maerov et al. | 57/34 B X |
| 3,332,125 | 7/1967 | Davis et al. | 57/34 B X |
| 3,411,287 | 11/1968 | Benson | 57/34 B X |
| 3,488,670 | 1/1970 | Benson | 57/34 B X |
| 3,608,299 | 4/1970 | Dugas | 57/34 B X |
| 3,971,202 | 7/1976 | Windley | 57/157 F X |

FOREIGN PATENT DOCUMENTS

| | | | |
|---|---|---|---|
| 828,641 | 2/1960 | United Kingdom | 57/157 F |

*Primary Examiner*—Donald Watkins
*Attorney, Agent, or Firm*—Bell, Seltzer, Park & Gibson

[57] ABSTRACT

An apparatus for continuously drawing and texturing core and effect yarns is disclosed. The apparatus for continuously drawing the core and effect yarns may be economically added to a conventional machine normally adapted to texture synthetic yarns by a texturing jet. The combining of the drawing and air jet texturing steps into a single continuous operation provides economy in yarn manufacture and also enhances the crimp imparted to the yarns by the texturing jet.

4 Claims, 2 Drawing Figures

APPARATUS FOR CONTINUOUSLY DRAWING AND TEXTURING CORE AND EFFECT YARNS

Figure 1:
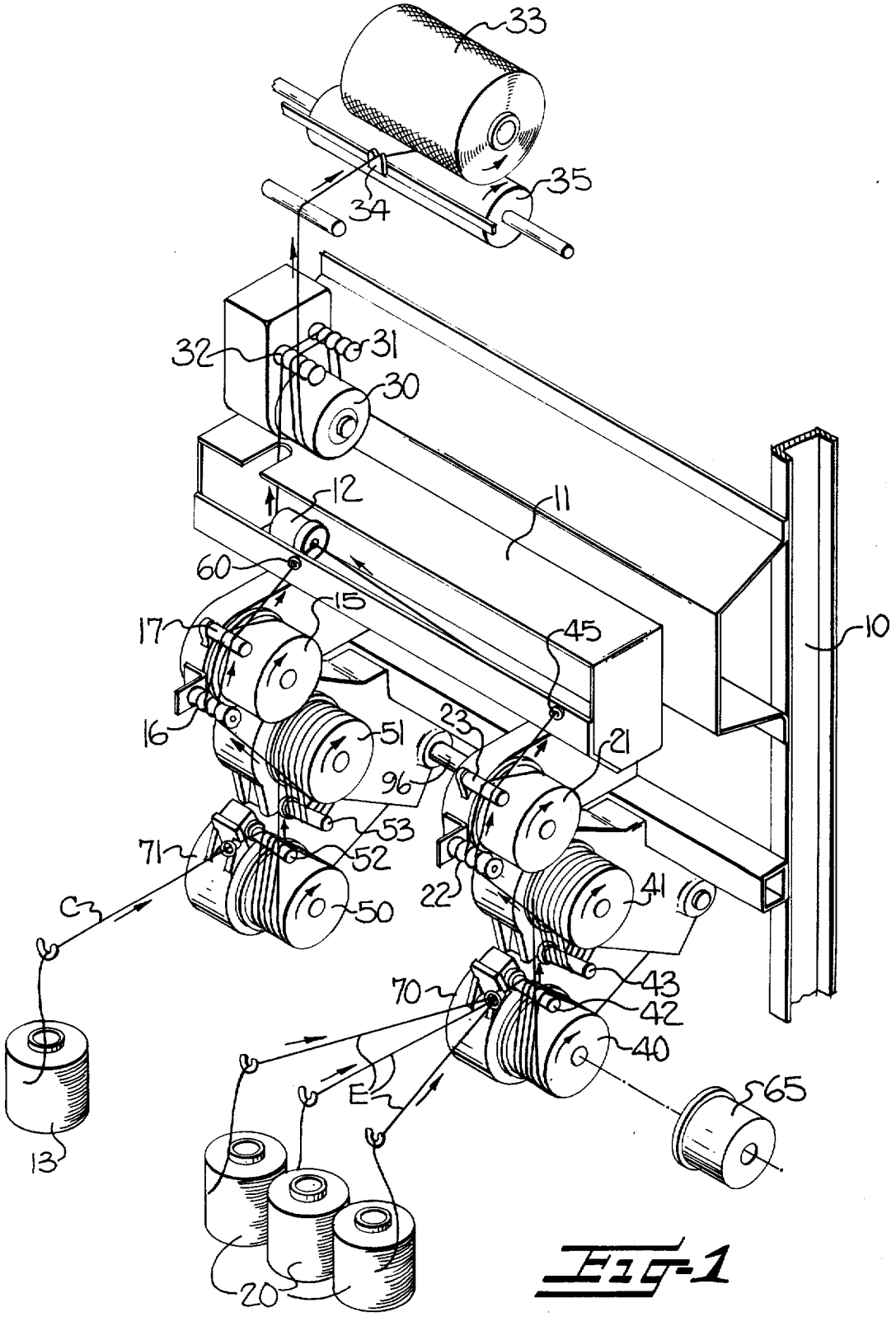

This invention relates generally to an apparatus for continuously drawing and texturing core and effect yarns and more particularly to such a method and apparatus which may be operated to economically produce relatively heavy denier core and effect yarns of the type normally used in upholstery fabrics and the like.

It is the normal practice for synthetic yarn producers to draw the yarn after it is extruded with a draw ratio of between about 2:1 to 6:1 and form it into a suitable package before it is shipped to the throwster where crimp is imparted to the yarn, as by the air jet texturing process. Of course, the separate drawing and texturing processes increase the cost of the crimped yarn. Also, the cost of maintaining the inventory the proper types of drawn yarn increases the cost of manufacture. When the two steps of drawing and air jet texturing are carried out separately, it is not possible to utilize the benefits of the drawing operation during the subsequent air jet texturing operation.

With the foregoing in mind, it is an object of the present invention to provide an apparatus for continuously drawing and texturing synthetic core and effect yarns to reduce the cost of the end yarn product, to maintain uniformity in the textured yarn, and to take advantage of the enhanced crimp which can be obtained by submitting the yarn to an air jet texturing operation immediately after and as a continuation of the drawing operation.

In accordance with the present invention, the yarn drawing means may be economically added to a conventional type of machine for texturing synthetic yarns by air jets. The drive means for operating the yarn drawing means is coordinated with and driven from the usual driving mechanism of the air jet texturing machine and includes means for making both minor and major changes in the draw ratio of the raw yarns as they are withdrawn from the yarn supplies and fed to the air jets.

More particularly, a first pair of spaced apart heated drawing rolls is provided to impart the desired amount of draw to the effect yarns as they are withdrawn from their yarn supplies and fed to the air jet and a second pair of heated drawing rolls is provided to impart the desired amount of draw to the core yarn as it is withdrawn from its yarn supply and fed to the air jet. Individual variable speed units are provided for each of the first and second pairs of heated draw rolls so that the draw ratio between the effect and core yarns can also be varied. Replacement hubs of different diameters are provided for the heated draw rolls for making minor variations in the draw ratio to compensate for variations in the denier of a yarn as it is received from the producer. The diameters of these replacement hubs are preselected to remove, as far as possible, the human error which would otherwise occur if it were left to the judgment of the machine operator to vary the draw ratio of different yarns.

Figure 2:
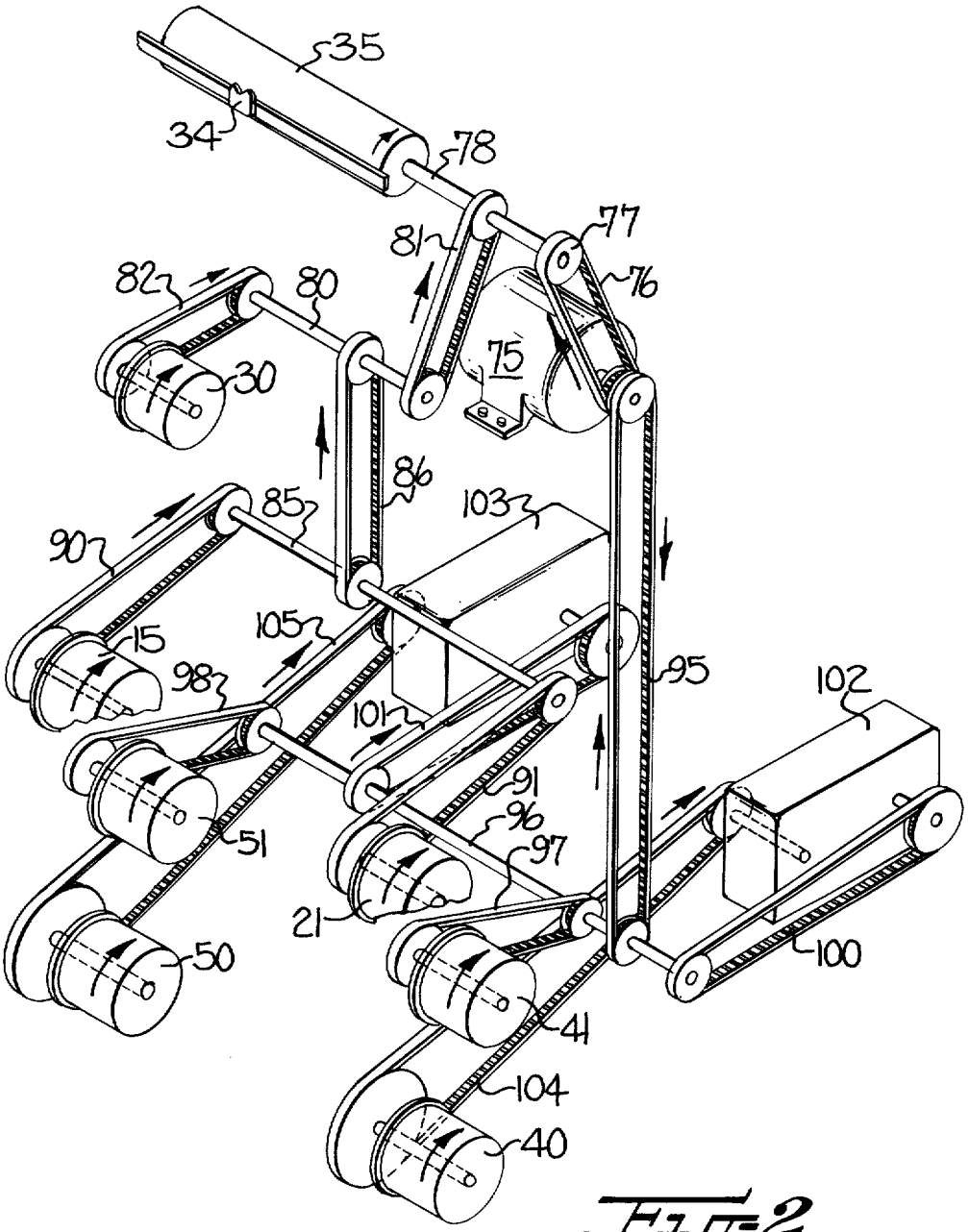

Other objects and advantages will appear as the description proceeds when taken in connection with the accompanying drawings, in which FIG. 1 is a fragmentary isometric view of a single station of an air jet texturing machine and illustrating the draw rolls for continuously drawing and texturing both the core and effect yarns applied thereto; and FIG. 2 is a view similar to FIG. 1 but illustrating the driving connection between the draw rolls and the yarn feeding rolls of the air jet texturing machine.

Although a particular type of air jet texturing machine is schematically illustrated in FIG. 1, it is to be understood that the continuous drawing and texturing method and apparatus in accordance with the present invention may be carried out on other types of air jet texturing machines. As shown in FIG. 1, the air jet texturing machine includes a frame 10 with a jet enclosure or housing 11 supported thereon and with a conventional type of texturing air jet 12 supported in the housing 11. A core yarn, indicated at C, is withdrawn from a supply package 13 and passes through suitable guide means so that is normally directed to and wound around a core yarn feed roll 15 and a pair of separator rolls 16, 17. The feed roll 15 is driven, in a manner to be presently described, so that the core yarn C is fed to the air jet 12 at a predetermined rate.

Effect yarns E are withdrawn from corresponding supply packages 20 and pass through suitable guide means so that they are normally directed to and wound round an effect feed roll 21 and separator rolls 22, 23. The effect yarns E are fed to the air jet 12 by rotation of the feed roll 21, in a manner to be presently described, and at a faster predetermined rate than the core yarn C so that the air jet imparts crimps to the effect yarns and intermingles them with the core yarn. The composite yarn exists from the jet 12 and is wound around a feed roll 30 and separator rolls 31, 32 before it is directed onto a take-up package 33 by a traversing yarn guide 34. The take-up package 33 is rotated by a drive roll 35 while the feed roll 30 and drive roll 35 are driven, in a manner to be presently described, so that the composite yarn is wound onto the take-up package 33 under the desired amount of tension.

In accordance with the present invention, yarn drawing means is provided for imparting the desired amount of draw to the yarns before they pass through the texturing air jet 12. To this end, a first pair of heated drawing rolls 40, 41, is positioned between the supply packages 20 for the effect yarns E and the jet 12 for drawing the individual effect yarns to the desired prior to their entry into the air jet 12. The heated draw rolls 40, 41 each includes a removable or replacement yarn engaging hub of a predetermined diameter. The effect yarns E are wound around the draw rolls 40, 41 and corresponding separator rolls 42, 43. The effect yarns E may be wound around the two sets of draw rolls and the separator rolls any predetermined number of complete wraps. In FIG. 1 the effect yarns E are shown being wound about the heated rolls 40, 41 and the separator rolls 42, 43 four complete turns. From the draw roll 41, the drawn effect yarns E are guided upwardly and wrapped around the separator rolls 22, 23 and the feed roll 21 before they pass through a yarn guide eyelet 45 in the housing 11.

The core yarn C is directed around a second pair of heated drawing rolls 50, 51 which are provided with corresponding separator rolls 52, 53. The core yarn C is also wound about both the first draw roll 50 and its corresponding separator roll 52 and the second draw roll 51 and its corresponding separator roll 53 four complete turns, prior to being wound about the separator roll 16 and 17 and the feed roll 15. The core yarn C is directed through a yarn guide eye 60 in the housing 11 and then into the air jet 12.

As illustrated in FIG. 1, replacement hubs, indicated at 65, are provided for varying the draw ratios of either the effect yarns E or the core yarn C. It is intended that replacement hubs 65 of different diameters will be provided for use in compensating for minor variations in denier of the yarns, as manufactured by the yarn producer. When a particular shipment of yarn is received, the producer can provide the throwster with sufficient information that the throwster will know the exact denier of the yarn received. Then, the throwster can use replacement hubs 65 of the proper diameter to provide the desired degree of draw to the yarns.

The first and second pairs of draw rolls 40, 41 and 50, 51 (FIG. 1) are each mounted for rotation on a respective casting 70, 71 which are designed to be quickly and easily attached to the frame 10 of the jet texturing machine so that they are aligned below the respective effect yarn feed roll 21 and the core yarn feed roll 15. The castings 70, 71 provide the proper rotational support for the pairs of draw rolls 40, 41 and 50, 51 and the castings 70, 71 are adapted to be secure in position on the frame of the jet texturing machine without requiring extensive modifications thereof.

As illustrated in FIG. 2, the conventional drive of the air jet texturing machine includes a main drive motor 75 which drives a timing belt 76 and a pulley 77 on a drive shaft 78. The take-up package drive rolls 34, only one of which is shown, are driven by the drive shaft 78 at the proper speed to rotate the take-up package 33. A drive shaft 80 is driven through a timing belt 81 from the drive shaft 78 and drives the yarn feed roll 30 by the timing belt 82. The drive shaft 80 drives a shaft 85 by means of a timing belt 86 and the feed rolls 15 and 21 are driven from the shaft 85 by means of timing belts 90, 91. While only one yarn texturing station is illustrated in the drawings, it is to be understood that the machine usually includes a plurality of side-by-side air jet texturing stations spaced along the machine and the drive shaft 78 extends along the length of the machine to drive corresponding feed rolls at each of the stations.

The drive for the first and second pairs of heated drawing rolls 40, 41 and 50, 51 is taken from the conventional drive of the machine provided by means of a timing belt 95 which is driven by the main drive motor 75 and in turn drives a shaft 96. Timing belts 97, 98 are driven by the drive shaft 96 and rotate the upper heated drawing rolls 41, 51 at predetermined speeds, depending upon the size of the drive pulleys on the drive shaft 96, the size of the drive pulleys on the drawing rolls, and the diameters of the drawing rolls. Timing belts 100, 101 impart rotation from the drive shaft 96 to the input sides of respective individual variable speed drive units 102, 103. Timing belts 104, 105 impart rotation from the output sides of the corresponding individual variable speed drive units 102, 103 to the drive pulleys of the lower heated drawing rolls 40, 50.

In order to effect a drawing of the yarns, the lower feed rolls 40, 50 are driven at a slower peripheral speed than the upper draw rolls 41, 51 so that the yarn is drawn out or stretched between the lower and upper draw rolls to impart the proper draw ratio thereto. The drawing rolls are heated in the usual manner and some of the heat imparted to the yarns by the heated draw rolls still remains in the yarns as they pass into and through the air jet 12. The heat remaining in the yarns as they pass through the air jet aids in enhancing the crimp imparted to the yarns during the air jet texturing operation.

The use of the variable speed drive units 102, 103 permits a wide variation of different types of drawing ratios to be imparted to the effect yarns E and/or the core yarn C so that a wide variety of core and effect yarns can be produced with the apparatus and method of the present invention. Various types of synthetic continuous filament yarn may be continuously drawn and air jet textured in accordance with the method and apparatus of the present invention, such as polyamides, polyesters, polyolefins, copolyamides and various combinations thereof. While various draw ratios and yarns of various deniers can be used, it has been found that satisfactory core and effect yarns for use in upholstery fabrics can be produced by three undrawn effect yarns E having a denier of approximately 300 denier each (a total of 900 denier) and these yarns are drawn to a total of about 300 denier with a draw ratio of 3:1. The undrawn core yarn C is also approximately 300 denier and is drawn with a draw ratio of 3:1 to approximately 100 denier. Of course, the temperature of the pairs of drawing rolls 40, 41 and 50, 51 will be varied, depending upon the speed of travel and the type of synthetic continuous filament yarns being continuously drawn and air jet textured.

In the drawings and specification, there has been set forth a preferred embodiment of the invention, and although specific terms are employed, they are used in a generic and descriptive sense only and not for purpose of limitation, the scope of the invention being defined in the claims.

That which is claimed is:

1. An apparatus for continuously drawing and texturing synthetic thermoplastic yarn by a texturing jet, said apparatus comprising a. a supply of core yarn, b. a plurality of separate supplies of individual undrawn effect yarns, c. a texturing jet spaced from said core and effect yarn supplies, d. first guide means for directing the individual effect yarns from said supplies and into said jet, said first guide means including positive feed roll means positioned in advance of said jet for feeding the individual effect yarns into said jet at a predetermined rate, e. second guide means for directing the core yarn from said supply into said jet, said second guide means including positive feed roll means positioned in advance of said jet for feeding the core yarn into said jet at a lesser rate than the individual effect yarns are fed into said jet, f. yarn drawing means positioned between said supplies of the effect yarns and said jet for drawing the individual effect yarns prior to entry of the effect yarns into said jet, g. means for varying the draw of the effect yarns, said draw varying means including replacement hubs for said heated draw rolls of different outer diameters to change the ratio of draw of the effect yarns, h. yarn take-up means spaced from said air jet, and i. guide means for directing the core and effect yarns from said jet to said yarn take-up means, said guide means including positive feed roll means positioned between said jet and said yarn take-up means for withdrawing both the core and effect yarns from said jet at the same rate.

2. An apparatus according to claim 1 wherein said yarn drawing means (f) comprises a pair of spaced apart heated drawing rolls, and driving means for rotating said heated drawing rolls at different peripheral speeds to effect a drawing of the individual effect yarns at a ratio of approximately 1:3.

3. An apparatus according to claim 1 including i. yarn drawing means positioned between said supply of core yarn and said jet for drawing the core yarn prior to entry of the core yarn into said jet.

4. An apparatus according to claim 3 wherein said yarn drawing means (i) comprises a pair of spaced apart heated drawing rolls, and driving means for rotating said heated drawing rolls at different peripheral speeds to effect a drawing of the core yarn.

* * * * *